US007460818B2

(12) United States Patent
Kozuma

(10) Patent No.: US 7,460,818 B2
(45) Date of Patent: Dec. 2, 2008

(54) IMAGE FORMING APPARATUS AND IMAGE FORMING METHOD

(75) Inventor: Itaru Kozuma, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 118 days.

(21) Appl. No.: 11/624,603

(22) Filed: Jan. 18, 2007

(65) Prior Publication Data

US 2007/0166078 A1 Jul. 19, 2007

(30) Foreign Application Priority Data

Jan. 19, 2006 (JP) ..... 2006-010815

(51) Int. Cl.
*G03G 15/01* (2006.01)

(52) U.S. Cl. ..... 399/227; 399/12; 399/38; 399/43; 399/162; 399/302

(58) Field of Classification Search ..... 399/227, 399/12, 82, 38, 43, 53, 160, 162, 223, 302, 399/16, 298
See application file for complete search history.

(56) References Cited

U.S. PATENT DOCUMENTS 7,065,314 B2 6/2006 Taguchi ..... 399/298
7,242,872 B2 * 7/2007 Okamoto et al. ..... 399/12
2005/0008405 A1 1/2005 Taguchi ..... 399/298
2006/0210314 A1 * 9/2006 Yamada et al. ..... 399/227
2006/0263107 A1 * 11/2006 Inukai et al. ..... 399/227 X

FOREIGN PATENT DOCUMENTS

JP 2002-351190 12/2002
JP 2005-003759 1/2005
JP 2005-201990 A * 7/2005

* cited by examiner

*Primary Examiner*—Sophia S Chen
(74) *Attorney, Agent, or Firm*—Hogan & Hartson LLP

(57) ABSTRACT

In a color printing mode of an image forming apparatus, two toner images in respective colors are formed and superimposed on an intermediate transfer belt. A gap D11 between toner images of the same color is narrowed while a gap D12 between toner images of different colors is widened, thereby corresponding to the switching of developers. In a printing mode that forms a monochrome image using one developer, gaps D21, D22 between the respective toner images are the same. In a printing mode that forms a monochrome image while switching four developers, a toner image formed immediately before the switching is shifted forward, thereby widening a gap D34 from the next toner image.

11 Claims, 9 Drawing Sheets

FIG. 4A : HOME POSITION
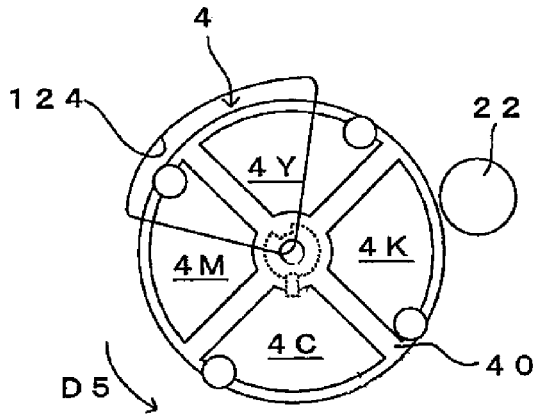
FIG. 4B : DEVELOPMENT POSITION
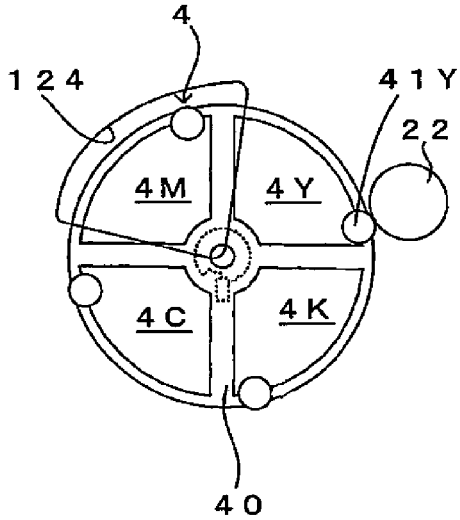
FIG. 4C : MOUNTING/DISMOUNTING POSITION
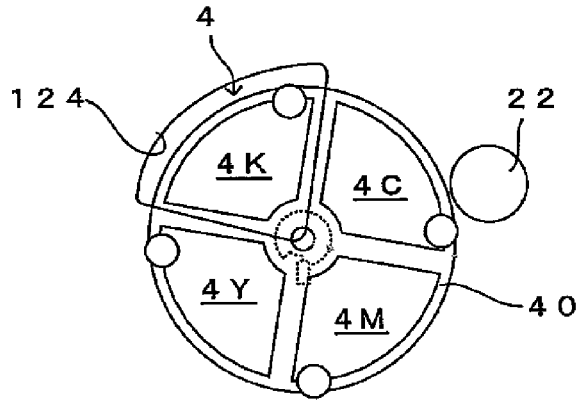

FIG. 5A : A3 SIZE
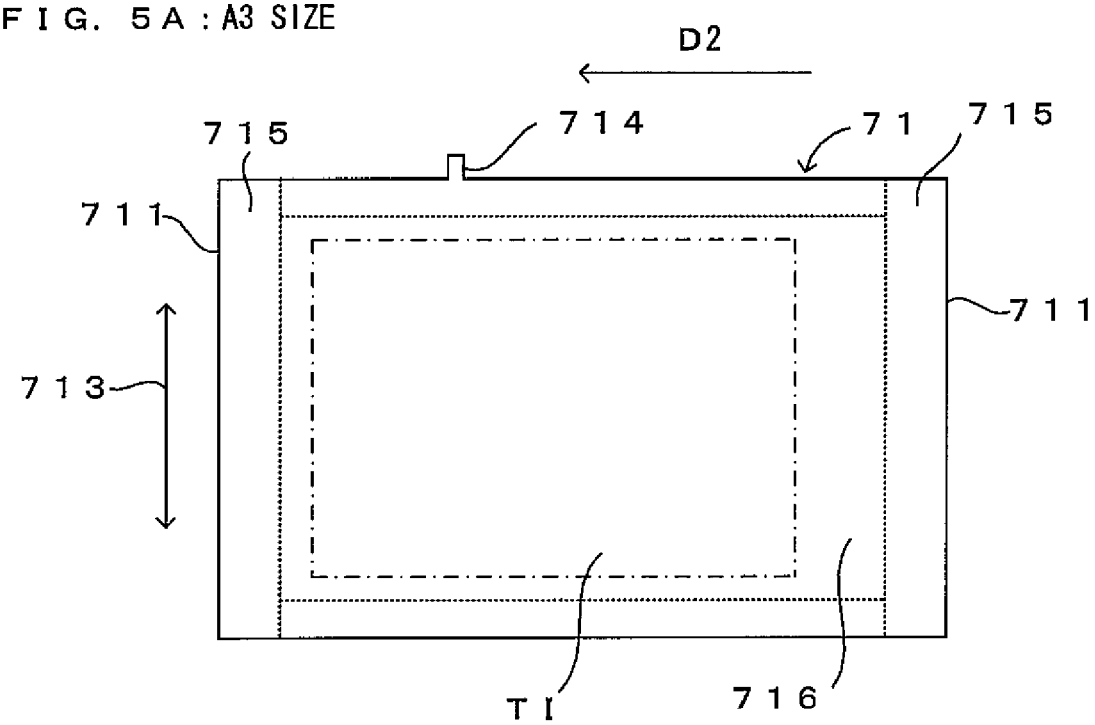
FIG. 5B : A4 SIZE
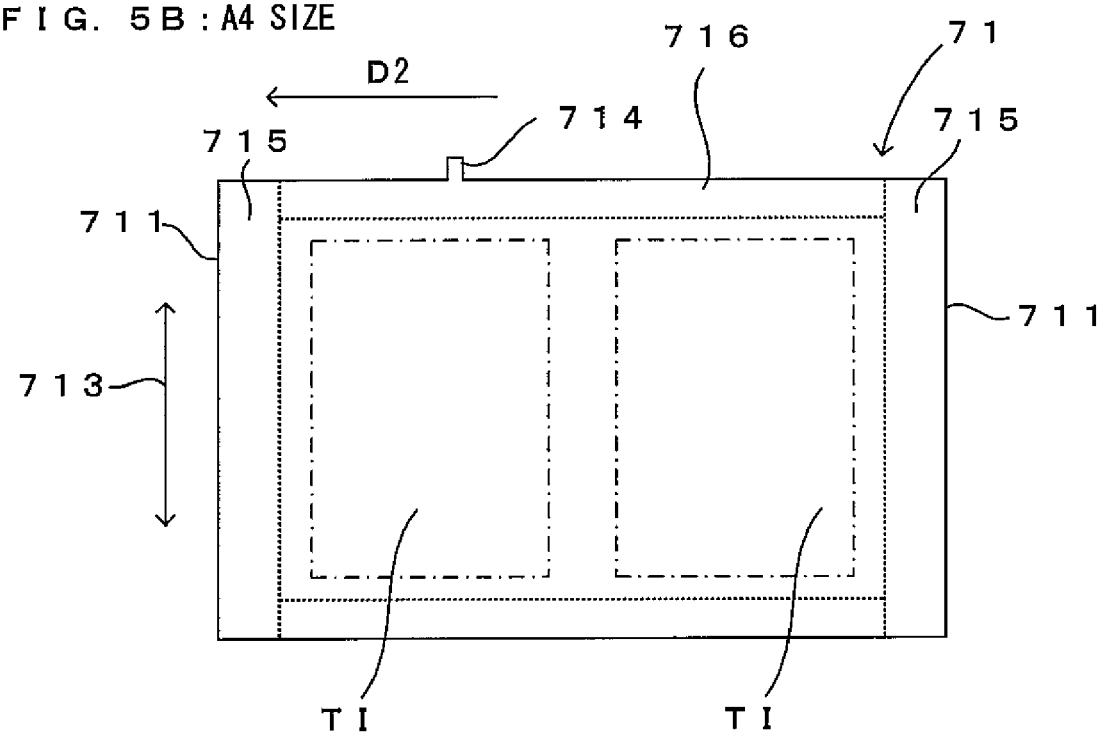

IMAGE FORMING APPARATUS AND IMAGE FORMING METHOD

CROSS REFERENCE TO RELATED APPLICATION

The disclosure of Japanese Patent Application No. 2006-010815 filed on Jan. 19, 2006 including specification, drawings and claims is incorporated herein by reference in its entirety.

BACKGROUND

1. Technical Field

The present invention relates to an image forming apparatus and an image forming method with which it is possible to continuously form images amounting to plural pages while switching plural developers which hold toner of the same color.

2. Related Art

Known image forming apparatuses equipped with multiple developers includes such an apparatus which forms full-color images using multiple developers which hold toner of different colors from each other and while switching from one developer to the other and forms monochrome images using one of such developers. In the image forming apparatus described in JP-A-2005-003759 for instance, a rotary developer seats four developers which respectively hold yellow toner (Y), magenta toner (M), cyan toner (C) and black toner (K), and this apparatus is capable of executing a color printing mode of superimposing on an intermediate transfer belt toner images of the respective colors which have been formed while switching the developers and accordingly forming a full-color image and a monochrome printing mode of forming a monochrome image fixing the developer to use to the black developer.

Further, in this image forming apparatus, images are formed at different positions on the intermediate transfer belt between the color printing mode and the monochrome printing mode. In the color printing mode, since respective color images need be superimposed one atop the other while switching from one developer to the other in, a particularly wide inter-image area is provided for every revolution of the intermediate transfer belt. On the contrary, for the monochrome printing mode which does not require switching of the developers, images are equidistant from each other.

Now, considering how this type of image forming apparatus is typically used, even if an apparatus is capable of forming a full-color image, the apparatus is often used to form a monochrome image. This has given rise to a thought that this type of apparatus may mount plural developers which hold toner of the same color and form monochrome images while switching from one developer to the other (which mode of use will be hereinafter referred to a "multiple monochrome use").

However, almost no consideration has been given to the issue of how the inter-image gaps should be set when one attempts to continuously form plural images using such an image forming apparatus which realizes the multiple monochrome use. For instance, as for the conventional image forming apparatus described above, while the color printing mode requires switching from one developer to the other for every revolution of the intermediate transfer belt, the gaps between images are determined based on the premise of not switching the developers for the monochrome printing mode. As these assumptions are invalid for an image forming apparatus which permits the multiple-monochrome use, application of this conventional technique to an image forming apparatus which permits the multiple-monochrome use will not necessarily result in an optimal result.

SUMMARY

An advantage of the invention is to provide a technique with which it is possible to properly set the gaps between images for an image forming apparatus of and an image forming method for continuously forming images amounting to plural pages while switching among plural developers which hold toner of the same color.

An image forming apparatus according to an aspect of the invention comprises: a positioning unit which is structured so as to mount plural developers holding toner of the same color and which selectively moves and positions one of the mounted developers to a predetermined development position; an image carrier which carries toner images on its surface and which rotates in a predetermined direction; and a controller which executes an image forming operation of forming a toner image using the developer positioned at the development position and making the image carrier carry the toner image, when a switching distance is defined as a distance that the surface of the image carrier moves during a switching time which is necessary to switch from the developer positioned to the development position to other developer by the positioning unit, the controller executes, as the image forming operation of forming three or more pages of toner images on the image carrier one after another while securing predetermined inter-image regions between the toner images, a switching-involving image forming operation of forming a predetermined number of pages of toner images using one developer, making the positioning unit switch the developer at the development position to the next developer, and thereafter forming toner images of subsequent pages using the next developer, and gaps between the toner images formed on the image carrier during the switching-involving image forming operation taken along the direction in which the image carrier moves are equal to or longer than the switching distance in a first inter-image region which is between the toner images which are formed immediately before and immediately after the switching of the developers but shorter than the switching distance in other inter-image regions.

With this structure, since the gaps between toner images amounting to plural pages are equal to longer than the switching distance only in the first inter-image region which corresponds to the switching of the developers but are shorter than the switching distance in other inter-image regions, it is possible to suppress the gaps between the toner images to the minimum necessary. As this permits forming toner images amounting to plural pages at a high throughput and shortening the circumferential length of the image carrier, it is possible to reduce the size of the apparatus according to the invention.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 4A, 4B and 4C are schematic diagrams each showing a stop position of the developing unit;

FIGS. 5A and 5B are developed views each showing an arrangement of the intermediate transfer belt;

BRIEF DESCRIPTION OF EXEMPLARY EMBODIMENTS

Figure 1:
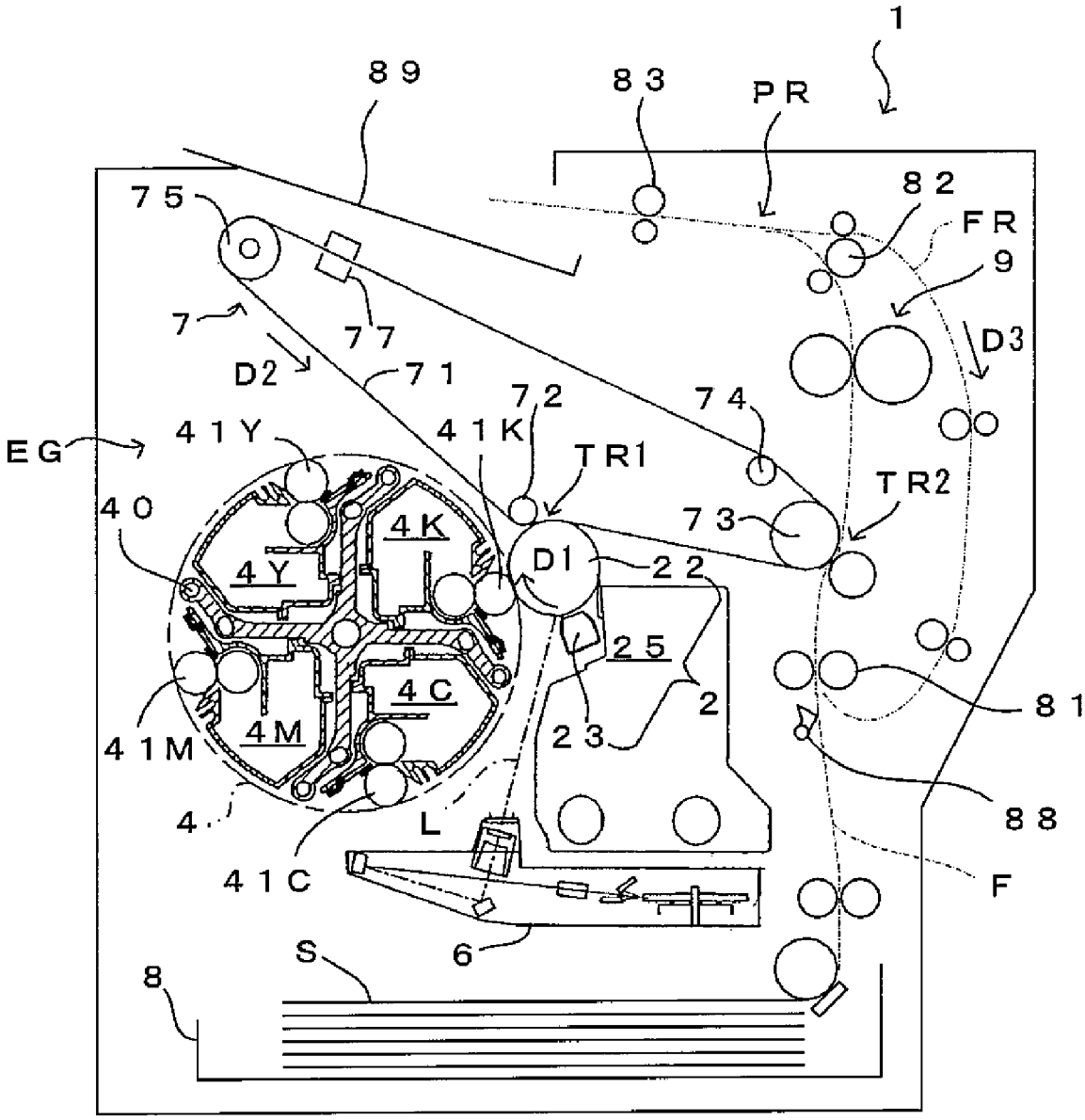
FIG. 1 is a diagram which shows an image forming apparatus according to an embodiment of the invention.
Figure 2:
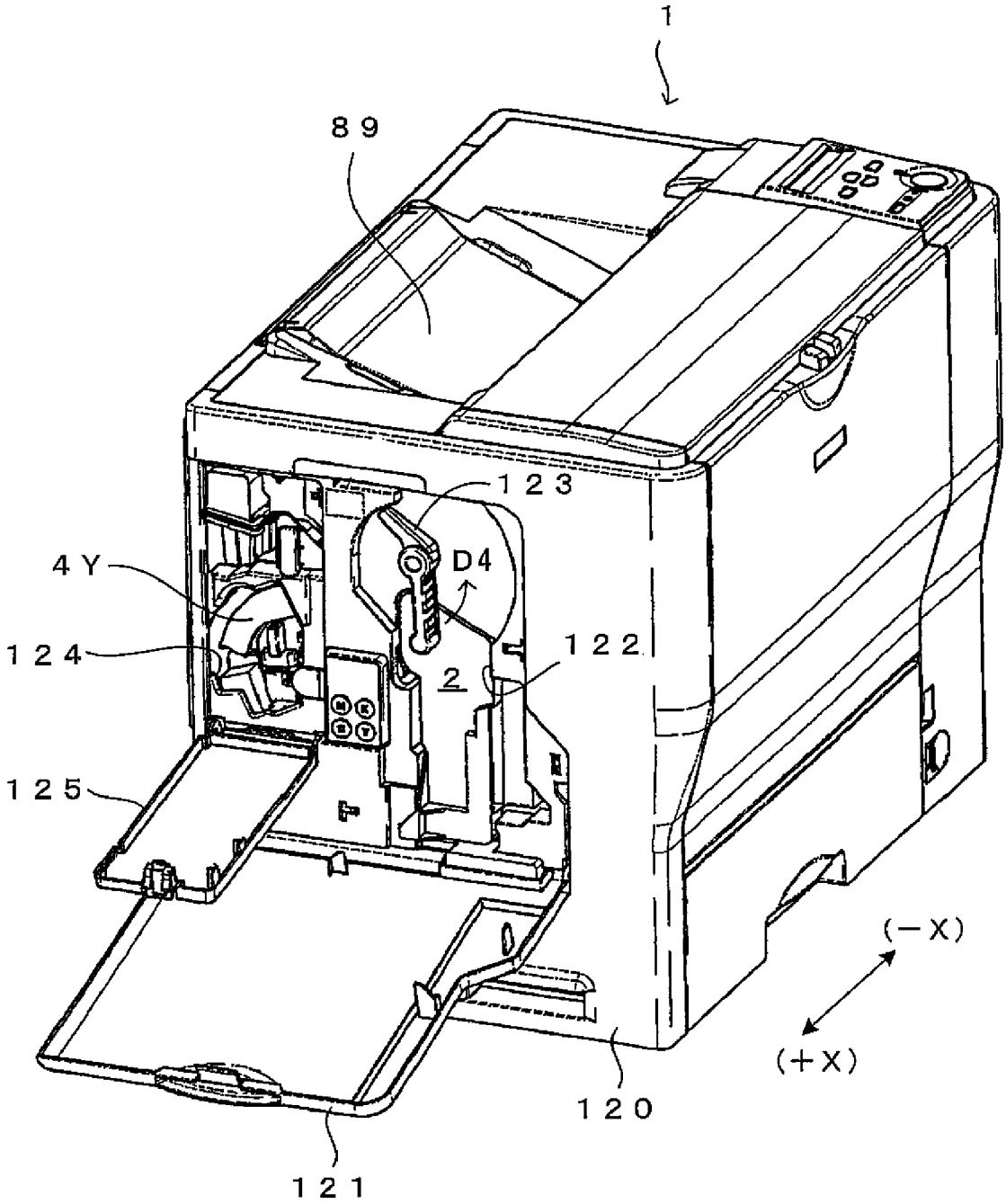
FIG. 2 is an external perspective view of the image forming apparatus of FIG. 1.
Figure 3:
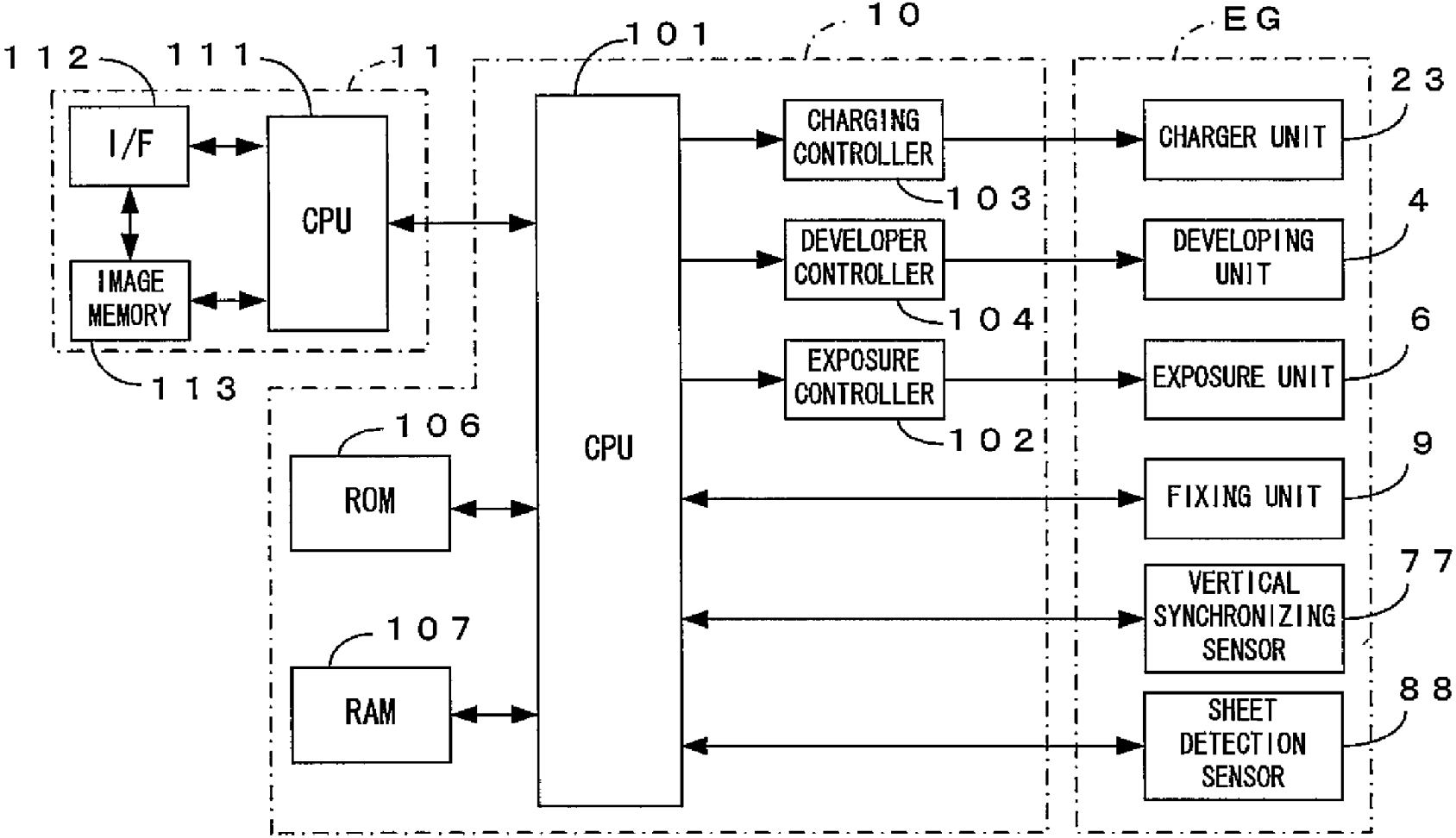
FIG. 3 is a block diagram which shows an electrical arrangement of the image forming apparatus of FIG. 1.

FIG. 1 is a diagram which shows an image forming apparatus according to an embodiment of the invention. FIG. 2 is an external perspective view of the image forming apparatus of FIG. 1. FIG. 3 is a block diagram which shows an electrical arrangement of the image forming apparatus of FIG. 1. The apparatus 1 is an image forming apparatus adapted to form a full color image by superimposing four color toners (developing agent) of yellow (Y), magenta (M), cyan (C) and black (K) (color print mode), and to form a monochromatic image using the toner of black (K) alone (monochromatic print mode). The image forming apparatus 1 operates as follows. When an external apparatus such as a host computer applies a print signal including an image signal to a main controller 11 via an interface 112, a CPU 111 of the main controller 11 converts the print signal into job data in a format suited for directing the operations of an engine EG and then outputs the resultant data to an engine controller 10. The engine controller 10, in turn, controls individual parts of the engine EG based on the job data sent from the CPU 111 so as to selectively carry out the color print mode or the monochromatic print mode for forming an image on a sheet S in correspondence to the image signal.

The engine EG is provided with a photosensitive member 22 rotatable along a direction of an arrow D1 as seen in FIG. 1. A charger unit 23, a rotary developing unit 4 and a cleaner 25 are arranged around the photosensitive member 22 along the rotational direction D1 thereof. The charger unit 23 is applied with a charging bias from a charging controller 103 so as to uniformly charge an outer periphery of the photosensitive member 22 to a predetermined surface potential. The photosensitive member 22, the charger unit 23 and the cleaner 25 are integrated into a photosensitive member cartridge 2. The photosensitive member cartridge 2 is designed to be bodily mounted to or dismounted from a main body of the apparatus 1, as shown in FIG. 2.

As shown in FIG. 2, the image forming apparatus 1 is provided with an openable outside cover 121 at a lateral side of an apparatus body 120 thereof. When a user, a service engineer or such opens the outside cover 121, a lateral side of the photosensitive member cartridge 2 is exposed via an aperture 122 for photosensitive member which is formed at the apparatus body 120. The photosensitive member cartridge 2 is released from a locked state by turning a lock lever 123 in a direction of an arrow D4, the lock lever serving to fix the photosensitive member cartridge to place. Thus, the photosensitive member cartridge 2 can be pulled out along a direction (+X) as shown in FIG. 2. On the other hand, a new photosensitive member cartridge 2 may be mounted to the apparatus body 120 by inserting the photosensitive member cartridge 2 through the aperture 122 for photosensitive member along a direction (−X) as shown in FIG. 2. Subsequently, the photosensitive member cartridge 2 is fixed to place by means of the lock lever 123. When the photosensitive member cartridge 2 is mounted in this manner, the aperture 122 for photosensitive member is substantially closed by the lateral side of the photosensitive member cartridge 2.

In the photosensitive member cartridge 2 mounted to the apparatus body 120 in the aforementioned manner, an exposure unit 6 irradiates a light beam L onto the outer periphery of the photosensitive member 22 charged by the charger unit 23. The exposure unit 6 irradiates the light beam L on the photosensitive member 22 according to a control command applied from an exposure controller 102 so as to form an electrostatic latent image corresponding to the image signal. When the external apparatus such as a host computer applies the image signal to the CPU 111 of the main controller 11 via an interface (I/F) 112, a CPU 101 of the engine controller 10 outputs a control signal corresponding to the image signal to the exposure controller 102 in a predetermined timing. In response to the control signal, the exposure unit 6 irradiates the light beam L on the photosensitive member 22 so that the electrostatic latent image corresponding to the image signal is formed on the photosensitive member 22.

The electrostatic latent image thus formed is developed into a toner image by means of the developing unit 4. In this embodiment, the developing unit 4 includes: a support frame 40 adapted to rotate about an axis; an unillustrated rotary driver; and a yellow developer 4Y, a magenta developer 4M, a cyan developer 4C and a black developer 4K which are each designed to be removably mounted to the support frame 40 and which each contain therein a toner of a color individual thereto. The apparatus body 120 is arranged in the following manner to permit the developers 4Y, 4M, 4C, 4K to be mounted thereto or dismounted therefrom. Specifically, the apparatus body 120 is provided with an aperture 124 for developer such that the developers 4Y, 4M, 4C, 4K may be mounted to or dismounted from the apparatus body via the aperture, as shown in FIG. 2. In addition, the apparatus body is provided with an openable inside cover 125 in a manner to cover the aperture 124 for developer. The inside cover 125 is disposed inwardly from the outside cover 121. That is, the outside cover 121 is so formed as to also cover the aperture 124 for developer and hence, it is impossible to open the inside cover 125 in a state where the outside cover 121 is closed. Conversely, it is impossible to close the outside cover 121 unless the inside cover 125 is closed. If the developing unit 4 is halted at a predetermined mounting/dismounting position when the user opens the inside cover 125, then the user can remove one of the mounted developers via the aperture 124 for developer. Additionally, the user can mount one developer via the aperture 124 for developer. Furthermore, the arrangement is made such that the rotary drive portion is operated thereby to position each of the developers 4Y, 4M, 4C, 4K at any of the following positions.

FIGS. 4A, 4B and 4C are schematic diagrams each showing a stop position of the developing unit. The developing unit 4 is driven into rotation in a direction of an arrow D5 based on a control command from the CPU 101 and is positioned at and locked to any of three positions by means of the CPU 101 and an unillustrated rotary locking mechanism. The three positions include: (a) a home position; (b) a development position; and (c) a mounting/dismounting position. Of these, the (a) home position is a position at which the developing unit is positioned when the image forming apparatus is in a standby state where the image forming operation is not performed.

Specifically, as shown in FIG. 4A, the developing unit is positioned in a state where each of the developers 4Y, 4M, 4C and 4K has, respectively, its developing roller 41Y, 41M, 41C and 41K spaced away from the photosensitive member 22, and where any one of the developers 4Y, 4M, 4C, 4K cannot be removed via the aperture 124 for developer provided at the apparatus body 120.

The (b) development position is a position at which the developing unit 4 is positioned when the electrostatic latent image on the photosensitive member 22 is developed with a toner of a selected color At each development position, as shown in FIG. 4B, the developing roller brought into face-to-face relation with the photosensitive member 22 (yellow developing roller 41Y in FIG. 4B for example) is applied with a predetermined developing bias thereby to develop the electrostatic latent image with the toner. When the developing unit 4 is positioned at this development position, as well, it is impossible to dismount any one of the developers via the aperture 124 for developer. In a case where the outside cover 121 is opened during the image forming operation, the image forming operations are immediately stopped whereas the developing unit 4 is moved to the home position before it is deactivated.

The (c) mounting/dismounting position is a position that the developing unit 4 can take only when the developer is mounted or dismounted. When the developing unit 4 is positioned at the mounting/dismounting position, one of the developers appears at the aperture 124 for developer, as shown in FIG. 4C, so that the developer may be removed via the aperture 124. FIG. 4C depicts the developer 4K of black exposed from the aperture 124 for developer. This state also permits a new developer to be mounted to the support frame 40 in place where the developer is not mounted. At the mounting/dismounting position, all the developing rollers disposed at the respective developers are spaced away from the photosensitive member 22. Thus, the arrangement is made such that the developing unit 4 permits the removal of only one of the developers that is exposed from the aperture 124 for developer when the developing unit 4 is positioned at the mounting/dismounting position. This eliminates a fear that the user may cause damage to the apparatus by inadvertently mounting or dismounting the developer.

In this image forming apparatus, the aforesaid development position and mounting/dismounting position are defined for each of the four developers 4Y, 4M, 4C, 4K and hence, the developing unit 4 has nine stop positions in total inclusive of one home position.

The developing unit 4 is controlled by a development control section 104, as shown in FIG. 3. The developing unit 4 is driven into rotation based on a control command from the developer controller 104. In the meantime, any one of the developers 4Y, 4C, 4M, 4K is selectively positioned at the development position to abut against the photosensitive member 22 or to oppose the photosensitive member via a predetermined gap therebetween. Furthermore, the developer controller 104 applies the developing bias to the developing roller of the developer positioned at the development position, thereby allowing the developing roller to supply the toner carried thereon to the photosensitive member 22. Thus, the electrostatic latent image on the photosensitive member 22 is developed in a selected toner color.

The toner image developed by the developing unit 4 in the aforementioned manner is primarily transferred onto an intermediate transfer belt 71 of a transfer unit 7 in a primary transfer region TR1. The transfer unit 7 includes the intermediate transfer belt 71 entrained about a plurality of rollers 72-75, and a driver (not shown) operative to drive the roller 73 into rotation thereby rotating the intermediate transfer belt 71 in a predetermined moving direction D2.

FIGS. 5A and 5B are developed views each showing an arrangement of the intermediate transfer belt. As shown in FIGS. 5A and 5B, the intermediate transfer belt 71 comprises an endless belt formed by joining substantially rectangular sheet members with each other at seams 711. In the figures, an arrow 713 indicates a direction of a rotary axis. The intermediate transfer belt 71 includes a projection 714 formed at one end thereof with respect to the rotary axis direction 713 (the upper side as seen in the figures), as well as a transfer inhibition region 715 and a transfer permission region 716. The transfer inhibition region 715 is defined by an area on either side of the seam 711, the area having predetermined dimensions and extending from one end to the other end of the intermediate transfer belt with respect to the rotary axis direction 713. On the other hand, the transfer permission region 716 is located centrally of the surface of the intermediate transfer belt 71 and is defined by a rectangular area excluding the opposite end portions of the intermediate transfer belt with respect to the rotary axis direction 713. The toner image is primarily transferred to the transfer permission region 716.

As shown in FIG. 5A, the transfer permission region 716 is designed to permit the transfer of a toner image TI of an JIS(Japanese Industrial Standard) A3 size, a longitudinal side of which extends in the rotational drive direction D2. In addition, as shown in FIG. 5B, the intermediate transfer belt 71 also permits the transfer of two toner images of an JIS A4 size or less, such as JIS A4, A5 or B5, the images carried substantially on the overall length thereof. The toner images are arranged in a manner to direct the shorter side thereof along the rotational drive direction D2. FIG. 5B shows the toner images TI of A4 size. In this embodiment, two toner images TI of A4 size or less are juxtaposed in the transfer permission region 716 along the rotational drive direction D2. However, as will be described herein later, the engine controller 10 controls such that the placement of the toner image TI on the intermediate transfer belt 71 may vary according to the color print mode or the monochromatic print mode.

A vertical synchronous sensor 77 comprises a photo-interrupter including a light emitting portion (such as an LED) and a photo-detector (such as a photo-diode) which are disposed in face-to-face relation. The vertical synchronous sensor is disposed near one end of the rotated intermediate transfer belt 71 with respect to the rotational axis direction 713, so as to detect the passage of the projection 714 and to output a detection signal. The detection signal outputted from the vertical synchronous sensor 77 at each detection of the projection 714 is used as a vertical synchronous signal which serves as a reference for the image forming process controlled by the CPU 101 of the engine controller 10. That is, the individual parts of the engine EG operate in synchronism with the vertical synchronous signal whereby the image forming process is carried out.

The image forming process includes: a step of forming the toner image TI by developing the latent image on the photosensitive member 22 by means of any one of the developers 4Y, 4M, 4C, 4K that is selectively transferred to the development position; and a step of transferring the resultant toner image TI to the intermediate transfer belt 71 moved in the predetermined moving direction D2. That is, toner images of four colors are formed by performing the image forming process each time the developers 4Y, 4M, 4C, 4K are switched from one to another and then, the toner images of four colors are superimposed on top of each other on the intermediate transfer belt 71 whereby a color image is formed (color print mode). The color image is formed in this manner and is secondarily transferred to the sheet S taken out from a cassette 8 on a sheet-by-sheet basis and transported along a transport path F to a secondary transfer region TR2.

In a case where a monochromatic image is transferred to the sheet S, on the other hand, the monochromatic image is formed by performing the image forming process for black color (monochromatic print mode). Subsequently, the same procedure as that for the color image is taken to transfer the resultant monochromatic image to the sheet S transported to the secondary transfer region TR2. Thus is obtained a print of the monochromatic image.

The embodiment manages a timing of feeding the sheet S to the secondary transfer region TR2 in order to ensure that the image on the intermediate transfer belt 71 is transferred exactly to a predetermined place on the sheet S. Specifically, a gate roller 81 is provided on the transport path F at place upstream from the secondary transfer region TR2, as shown in FIG. 1. Further, a sheet detection sensor 88 is provided on the transportation path F at an upstream place of the gate roller 81. The sheet detection sensor 88 is composed of a microswitch or a photo interrupter for example, and detects whether a sheet S exists on the transportation path F or not. The CPU 101 can determined the sheet S is transported on right timing or not. The gate roller 81 is rotated as timed to the cycling motion of the intermediate transfer belt 71, thereby feeding the sheet S to the secondary transfer region T12 in a predetermined timing.

The sheet S thus formed with the color image or the monochromatic image is transported to a discharge tray 89 via a fixing unit 9, a pre-discharge roller 82 and a discharge roller 83, the discharge tray disposed on an upper side of the apparatus body 120. In a case where the image is formed on both sides of the sheet S, the rotation of the discharge roller 83 is reversed at a point of time that a trailing end of the sheet S formed with the image on one side thereof is transported to a reversal position PR, so that the sheet S is transported along a reversal transport path FR in a direction of an arrow D3. Thereafter, the sheet S is loaded again on the transport path F at place upstream from the gate roller 81. At this time, the sheet S is positioned in a manner that its side opposite from the side previously formed with the image is pressed against the intermediate transfer belt 71 in the secondary transfer region. TR2 so as to be transferred with the image. In this manner, the image may be formed on the both sides of the sheet S.

In FIG. 3, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

The structure of this image forming apparatus 1 further permits the image forming operation in a state that four developers which hold toner of the same color are mounted. That is, the shapes of the developers mounted to the developing unit 4 are approximately the same, and therefore, it is possible for instance to mount another one of the black developers instead of the magenta developer 4M. This similarly applies to the other toner colors as well: it is possible to mount four black developers to the developing unit 4. As for which toner color the mounted developers correspond to, it is possible to know this by storage in memories which are disposed in the respective developers, making the outer shapes of the developers partially different from each other color, or otherwise appropriately.

In a state that the four developers which hold toner of the same color are mounted, the image forming apparatus 1 operates as an apparatus dedicated to monochrome images in this toner color. Forming images while switching among the four developers properly, this apparatus continuously forms a great number of monochrome images. That is, even when one developer runs out of toner, it is possible to continuously form images using other developer. Further, as toner inside the developers gets agitated as the entire developing unit 4 rotates during switching of the developers, images are formed using fresh toner, which is advantageous in terms of quality as well. Further, while it is known that the quality of initially formed images may be inferior when formed using a developer which has been left unused for a long time, switching of the developers at regular intervals solves this problem.

Figure 6:
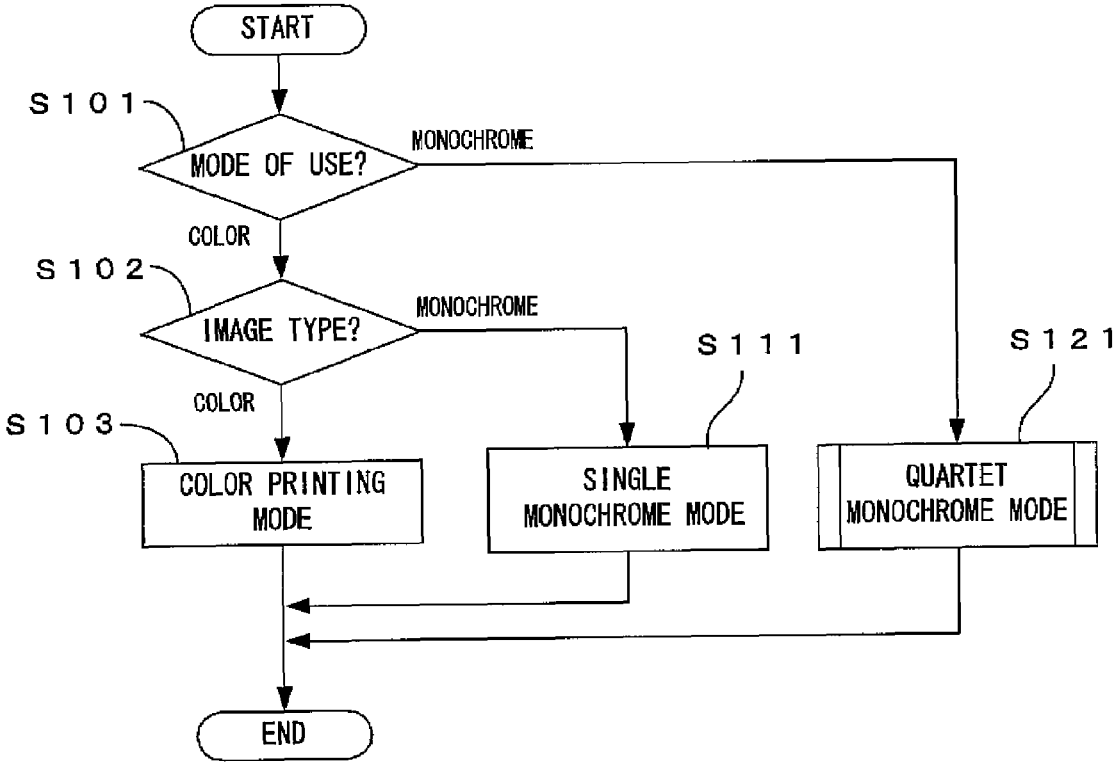
FIG. 6 is a flow chart which shows the image forming operation in this apparatus.

FIG. 6 is a flow chart which shows the image forming operation in this apparatus. The image forming operation is performed upon receipt of the print command signal from an external apparatus. During this operation, first, the mode of use of the apparatus is judged (Step S101). This is judged in accordance with the type of the developers mounted to the developing unit 4. In short, it is determined that the apparatus is in a color mode when the four developers mounted to the developing unit 4 correspond to toner colors which are all different from each other, whereas it is determined that the apparatus is in a monochrome mode when the four developers all correspond to the same toner color.

The operation in the color mode will be described first. In this instance, based on the instruction content of the print command signal, the image type, i.e., whether an image to form is a color image or a monochrome image is judged (Step S102). In the event that an image to form is a color image, the engine part EG operates in the color printing mode and a necessary color image is formed (Step S103). The color printing mode is an operation mode of forming toner images of the respective colors one after another while positioning the four developers one after another to the development position and thereafter superimposing these toner images one atop the other on the intermediate transfer belt 71.

Meanwhile, when an image to form is a monochrome image, one of the four developers (which is generally the black developer 4K) moves to the development position, and all necessary images are formed using this developer. This operation of forming images using only one of the four developers will be herein referred to as the "single monochrome mode" (Step S111).

Since the color printing mode and the single monochrome mode mentioned above are known operations which image forming apparatuses having ordinary structures perform, and hence, will not be described in detail.

An operation will now be described for an instance that the apparatus is in the monochrome mode, that is, toner held inside the four developers is of the same color. In this instance, the engine part EG operates in a quartet monochrome mode for forming monochrome images while appropriately switching among the four developers (Step S121). Even though the print command signal calls for color images, the main controller 11 converts a color image signal into a monochrome image signal and the engine part EG forms monochrome images which correspond to this image signal. The specific operation in the quartet monochrome mode will be described later.

Figure 7:
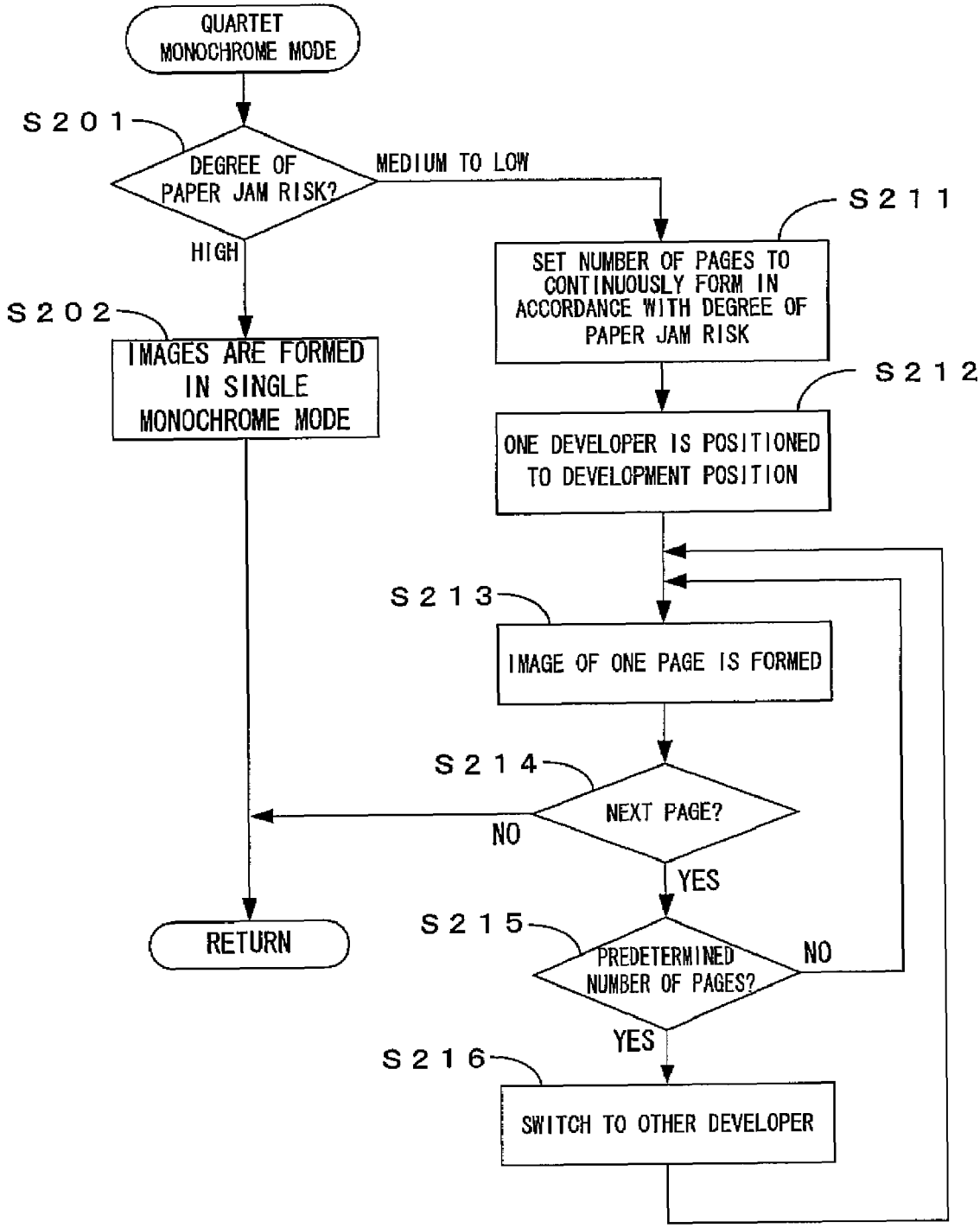
FIG. 7 is a flow chart which shows the quartet monochrome mode.

FIG. 7 is a flow chart which shows the quartet monochrome mode. First, the degree of paper jam risk is determined (Step S201). In this printing mode, the scheme of switching of the developers is changed in accordance with the degree of paper jam risk. The reason is as follows. While monochrome images amounting to plural pages are formed while switching the developers in this printing mode in a manner described later, the gaps between images on the intermediate transfer belt 71 temporarily become irregular upon switching of the developers. This temporarily makes the timing of transporting a sheet S irregular and easily causes a jam, in accordance with the degree of paper jam risk at that time, the scheme of switching of the developers is changed.

The degree of paper jam risk can be determined based on how many jams occurred during the most recent transportation of a certain number of sheets (e.g., 100 sheets). Whether there is a jam can be detected from the output from the sheet detection sensor 88 which is disposed on the transportation path F. In other words, when a sheet S has failed to arrive at the detection position at right timing, when the sheet S has failed to move passed the detection position even after a predetermined period of time, etc., it is concluded that a jam has occurred. If the degree of paper jam risk was high in the past, the degree of paper jam risk at present is considered to be high.

Alternatively, the time in which the sheet S moves passed the detection position may be calculated from the output from the sheet detection sensor 88, and the degree of paper jam risk may be determined in accordance with the result. That is, due to wear, smudge and the like of the rollers on the transportation path F, the surrounding environment such as the temperature and the humidity, the quality of the sheet S, etc., the sheet S may be transported other than at an intended transportation speed. To note in particular is that if the sheet S slips on the transportation path F, the sheet S may need more time than intended until it has finished moving passed the detection position. Such easily causes a jam because of the different transportation speeds between the different sheets. It is therefore considered that the greater the delay of transportation of a sheet is, the higher the degree of paper jam risk is.

When it is determined that the degree of paper jam risk is high, the engine part EG operates in the single monochrome mode described above, thereby forming images (Step S202). This is because since switching of the developers is not carried out in the single monochrome mode, it is possible to maintain the inter-image gaps wide and constant and therefore suppress the probability of occurrence of a jam.

On the contrary, when the degree of paper jam risk is medium or low, the number of pages to continuously form is set in accordance with the degree of risk (Step S211). The number of pages to continuously form is the maximum number of pages of images which are formed continuously using one developer For example, the number of pages to continuously form is set to 8 when the degree of paper jam risk is medium but to 16 when the degree of paper jam risk is low.

Following this, the developing unit 4 rotates, thereby moving and positioning one of the four developers to the development position which is opposed against the photosensitive member 22 (Step S212), and using this developer, an image of one page is formed (Step S213). A method of choosing the developer to use at this stage may be (1) to select one which can move fastest to the development position; (2) to select one which, among the four, has not been used for the longest time; (3) to select one which holds the least amount of remaining toner; (4) to select one which holds the greatest amount of remaining toner, etc. With the method (1), it is possible to minimize the first print time. With the method (2), it is possible to prevent deterioration of the image quality attributable particularly to nonuse of a particular developer over a long period of time. The method (3), preferring use of the developer which holds the smallest amount of remaining toner, prevents plural developers from running short of toner one after another. Further, with the method (4), it is possible to average out the remaining toner amounts in the respective developers.

Upon formation of the image of one page, whether there still are images corresponding to the subsequent pages to form is determined (Step S214). But for images of the next page to form, the operation ends. On the contrary, when there still are images to form continuously, whether the number of pages of images successively formed using this developer has reached the number of pages to continuously form set earlier is determined (Step S215). If this number is below the number of pages to continuously form, the sequence returns to Step S213 and an image of the next page is formed. On the contrary, if this number has reached the number of pages to continuously form, switching of the developers is carried out (Step S216). That is, the developing unit 4 rotates 90 degrees, the developer which used be used until this point retracts from the development position and the developer next to this developer is newly set to the development position. The sequence then returns to Step S213, and an image of the next page is formed using the developer thus newly positioned to the development position.

In other words, in the quartet monochrome mode, every time the number of pages of images successively formed using one developer reaches the number of pages to continuously form, one developer takes over other developer. This secures that the developers are used evenly, and prevents deterioration of the image quality attributable to nonuse of the developers. Further, since the toner inside the developers is agitated as the developing unit 4 rotates, it is possible to form images in an excellent quality over a long period of time. In addition, this realizes omission of agitating mechanisms which unless otherwise need be disposed within the developers, thereby reducing the size of the developers and increasing the capacity of the developers.

As formation of images stops temporarily while one developer is being replaced with other developer, if the frequency of switching becomes high, a lowered throughput of image formation will become a problem. Noting this, this embodiment improves the position at which the images are formed on the intermediate transfer belt 71 and prevents deterioration of the throughput.

Figure 8A:
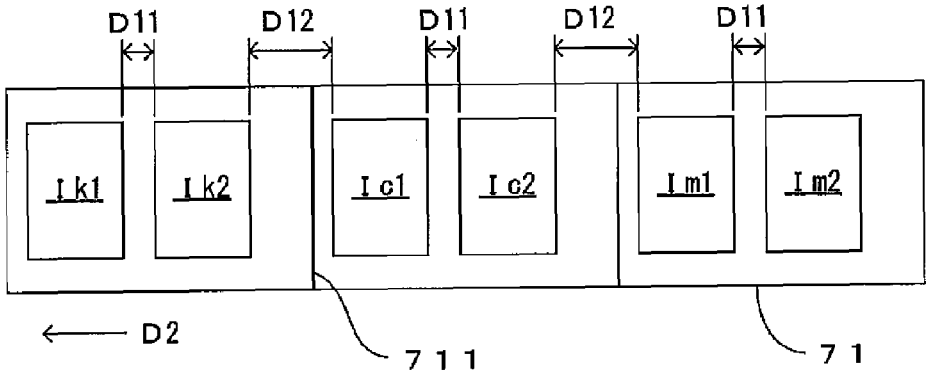
FIGS. 8A, 8B and 8C are drawings which show the arrangements of images on the intermediate transfer belt.
Figure 8B:
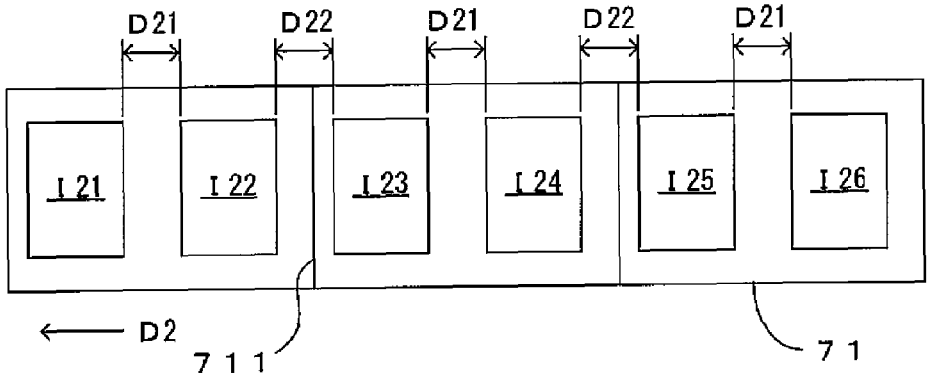
Figure 8C:
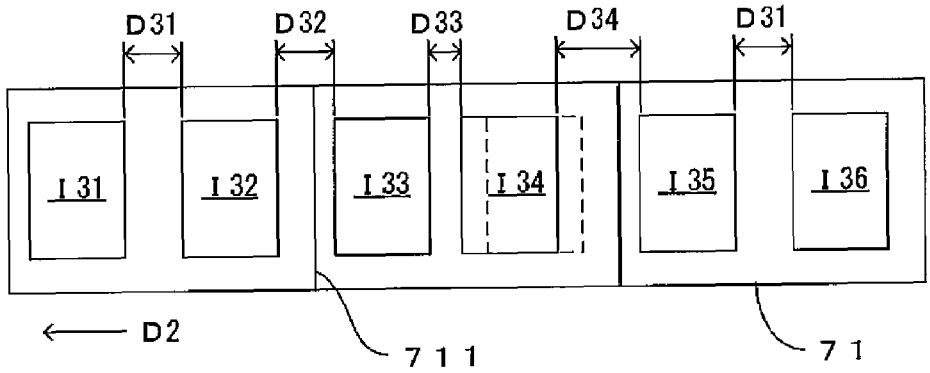

FIGS. 8A, 8B and 8C are drawings which show the arrangements of images on the intermediate transfer belt. Illustrated in these drawings are the arrangements of images, for the respective printing modes, as they are when the operation of forming two JIS A4-size images on the peripheral surface of the intermediate transfer belt 71 per revolution is performed for plural revolutions. These drawings are schematic drawings showing the intermediate transfer belt 71 as it is developed in a plane. For each printing mode, each associated drawing shows the arrangement of the images as it is for three revolutions of the intermediate transfer belt 71.

A. Color Printing Mode

In the color printing mode (FIG. 8A), toner images in the respective colors are superimposed one atop the other on the intermediate transfer belt 71, and therefore, it is necessary to switch from one developer to other every time the intermediate transfer belt 71 rotates one revolution. While two toner images Ik1 and Ik2 are formed first with black toner on the intermediate transfer belt 71 as they are spaced apart over a predetermined gap D11 for instance, and two toner images Ic1 and Ic2 are then formed with cyan toner at positions which overlap the black toner images Ik1 and Ik2, the second black toner image Ik2 is spaced apart by a wider gap D12 than the gap D11 from the first cyan toner image Ic1 at this stage.

The gap D12 is a length which is determined in accordance with the necessary time for switching of the developers. In short, the relation below must hold true where Tex denotes the time needed for switching of the developers, namely, the period of time since it became impossible to form images using the previous developer due to the switching until it becomes possible to form images using the next developer, and V denotes the travel speed of the surface of the intermediate transfer belt 71:

$$D12 \geqq \mathrm{Dex} = V \cdot \mathrm{Tex}$$

The symbol Dex denotes a distance that the surface of the intermediate transfer belt 71 moves while one developer gets replaced with other developer, and therefore, is the minimum possible gap between toner images of mutually different colors.

In short, the gap D12 between the second black toner image Ik2 and the first cyan toner image Ic1 and that between the second cyan toner image Ic2 and the first magenta toner image Im1 must be equal to or longer than this distance Dex. Although there is no such restriction upon the gap between the first black toner image Ik1 and the second black toner image Ik2, that between the first cyan toner image Ic1 and the second cyan toner image Ic2 and that between the first magenta toner image Im1 and the second magenta toner image Im2, if these gaps are too short, the gaps on the transportation path F for between sheets S upon which these toner images need be transferred also become short, thereby easily giving rise to a jam. Further, in order to send a sheet S to the secondary transfer region TR2 in synchronization to rotations of the intermediate transfer belt 71, it is necessary to temporarily stop the gate roller 81 for every feeding of each sheet S, hold the sheet S on standby before the secondary transfer region TR2 and rotate the gate roller 81 again in synchronization to rotations of the intermediate transfer belt 71. The gap D11 therefore needs be determined considering the safety against a jam and control of the operation of the gate roller 81. With respect to the design, the circumferential length of the intermediate transfer belt 71 is determined based on these gaps and the sizes of images.

From a perspective of image quality, a toner image should not be carried on or in the vicinity of the seam 711 of the intermediate transfer belt 71. It is desirable instead that a toner color changes to other toner color across the seam 711.

B. Single Monochrome Mode

In the single monochrome mode (FIG. 8B), toner images I21 through I26 are formed continuously without switching of the developers. It is therefore unnecessary to secure wide gaps between the toner images for the purpose of switching. While this provides the freedom of setting the gap D21 between the first toner image I21 and the second toner image I22 which are formed during the first revolution of the intermediate transfer belt 71, the gap D22 between this toner image I22 and the third toner image I23 which is formed during the second revolution, . . . , to any desired values without the restriction imposed by the distance Dex described above, it is more preferable that D21=D22 holds. The reason is as described below.

In the color printing mode, toner images in of the four colors are superimposed one atop the other on the intermediate transfer belt 71 and then transferred onto a sheet S, and therefore, the number of sheets S fed onto the transportation path F is two for every four revolutions of the intermediate transfer belt 71. Due to this, a jam will not easily occur even despite narrow gaps between toner images as shown in FIG. 8A. Meanwhile, since two sheets S are transported sequentially for every revolution of the intermediate transfer belt 71 in the single monochrome mode, the degree of paper jam risk with narrow gaps is far higher than that in the color printing mode. Hence, it is desirable for prevention of a jam, that the gaps between toner images are as wide as possible. Further, as the cycle of feeding sheets becomes constant when the gaps between toner images are constant, control of the operation of the apparatus can be simpler, which is another effect.

C. Quartet Monochrome Mode

A different consideration must be given to the quartet monochrome mode (FIG. 8C), which requires forming images while switching from one developer to other, than those for the color printing mode and the single monochrome mode. This is because switching of the developers is carried out at different timing than in these other printing modes. In the event that images are positioned in a similar arrangement to that in the color printing mode described above, the switching operation gives rise to no problem as the timing which enables switching of the developers is set for each revolution of the intermediate transfer belt 71.

However, this enhances the degree of paper jam risk. This is because two sheets S are transported sequentially for every revolution of the intermediate transfer belt 71 as in the single monochrome mode. For suppression of a jam therefore, the gaps between toner images are ideally as wide as possible. When one tries to evenly enlarge the gaps between toner images however, it is not possible to ensure a necessary gap for switching of the developers. Nevertheless, extension of the circumferential length of the intermediate transfer belt 71 will decrease the throughput in other printing modes and increase the size and the cost of the apparatus.

In light of this, in the quartet monochrome mode according to this embodiment, as shown in FIG. 8C, the gaps between toner images are widened when switching of the developers is not performed as in the single monochrome mode, whereas during the revolution immediately prior to switching, the gap D33 between the third toner image I33 and the fourth toner image I34 which will be formed during this revolution is reduced as in the color printing mode. That is, the toner image I34 is formed before (on the left-hand side in FIG. 8C) the region which is supposed to include this toner image but for switching (i.e., the region denoted at the dotted line in FIG. 8C), thereby widening the gap D34 from the next toner image I35. This makes the gap D34 between the toner images I34 and I35 equal to the distance Dex described above or more, which permits switching the developers utilizing this gap D34, or in more strict words, utilizing a period of time during which no toner image is formed on the photosensitive member 22 for the purpose of creating the gap D34 on the intermediate transfer belt 71. It is thus possible in the quartet monochrome mode to attain the same throughput as those in the other printing modes while suppressing occurrence of a jam.

While FIG. 8C shows switching of the developers between the fourth toner image I34 and the fifth toner image I35, in the actual apparatus, one developer takes over other developer between the eighth and the ninth toner images (in the case that the number of pages to continuously form is 8) or between the sixteenth and the seventeenth toner images (in the case that the number of pages to continuously form is 16).

The gap D33 between the toner images I33 and I34 may have the same value as that of the gap D11 between the toner images Ik1 and Ik2 which is used in the color printing mode for instance. Further, the gap D34 between the toner images I34 and I35 may have the same value as that of the gap D12 between the toner images Ik2 and Ic1 which is used in the color printing mode for example. The gap D31 between the toner images I31 and I32 and between the toner images I35 and I36 may have the same value as that of the gap D21 between the toner images I21 and I22 which is used in the single monochrome mode for example. In addition, the gap D32 between the toner images I32 and I33 may have the same value as that of the gap D22 between the toner images the toner images I22 and I23 which is used in the single monochrome mode for instance when all of this is applied, the image arrangement on the intermediate transfer belt 71 in the quartet monochrome mode becomes the same as that during the revolution immediately prior to switching of the developers in the color printing mode, but during the other revolutions, becomes the same as that in the single monochrome mode. In short, at this stage, in the quartet monochrome mode, the image arrangement in the color printing mode and that in the single monochrome mode are used for the respective purposes. This reduces the types of the image arrangement on the intermediate transfer belt 71 and the sheet transporting timing down to only two, which makes it easy to design the intermediate transfer belt 71 and control the transportation system.

In the quartet monochrome mode, the reduced gap between the toner images I33 and I34 increases the degree of paper jam risk. However, since the gap in this instance is merely about the minimum gap in the color printing mode and since switching of the developers is performed only for every four revolutions of the intermediate transfer belt 71 (where the number of pages to continuously form is 8) or eight revolutions of the intermediate transfer belt 71 (where this number is 16), the degree of paper jam risk is not necessarily extremely higher than those in the other printing modes.

It is nevertheless true that the higher the frequency of switching, the higher the degree of paper jam risk. Considering this, as described earlier, the frequency of switching is set low or not carried out when the apparatus is prone to a jam in this embodiment.

As described above, in this embodiment, when toner images are to be formed while switching the developers corresponding to the same toner color, the location of a toner image to form immediately before the switching is shifted forward from the originally intended position, thereby ensuring a gap between toner images which is necessary for switching of the developers. As the developers are switched in this manner, it is possible to form numerous images in an excellent quality for a long time.

Further, since the gaps between toner images are widened as much as possible even at other timing than at the developers switching timing, it is possible to effectively suppress occurrence of a jam. In addition, since the gaps between toner images are widened only for switching of the developers, it is possible to prevent lowering of the throughput.

While the foregoing has described an instance that toner images amounting to two JIS A4-size pages are formed on the intermediate transfer belt 71, the following may be viable as for sheets of other sizes. The first consideration is given on sheets of the JIS A3 size. In this case, as shown in FIG. 5A, only one toner image can be formed on the intermediate transfer belt 71. Hence, the toner image arrangement remains the same between the respective printing modes. It is possible to switch the developers at any desired timing in the quartet monochrome mode. This equally applies to sheets of the JIS B4 size. With respect to sheets of the JIS B5 size, even with this size, the intermediate transfer belt 71 can carry only two pages of toner images simultaneously. The intermediate transfer belt 71 must be longer to carry three or more pages of toner images, which reduces the throughput on other sizes. In this case, since the gaps between toner images are wider than those described above, it is possible to switch the developers at any desired timing.

The invention is thus particularly effective in an image forming apparatus which uses such an intermediate transfer belt whose size is determined in an effort to carry toner images having a certain size over multiple pages at the same time with a predetermined gap between the toner images. Further, in this embodiment, while the toner image arrangement remains the same as that in the color printing mode (FIG. 8A) with switching of the developers for every two pages, the effect of the invention is particularly remarkable in an apparatus which is structured so as to switch the developers after forming on the intermediate transfer belt, with one developer, toner images amounting to the number of pages (two pages in this embodiment) which the intermediate transfer belt can carry. In this embodiment, since the number of toner image pages to form using one developer (the number of pages to continuously form) is 8 or 16, the effect of the invention manifests itself prominently.

As described above, in this embodiment, the developing unit 4 functions as the "positioning unit" of the invention. Meanwhile, the intermediate transfer belt 71 functions as the "image carrier" and the "intermediate transfer member" of the invention. The photosensitive member 22 and the engine controller 10 function respectively as the "latent image carrier" and the "controller" of the invention. The rollers 81 through 83 and the like which form the transportation path F collectively functions as the "transporter" of the invention. The sheet detection sensor 88 functions as the "jam detector" and the "recording member detector" of the invention. The transportation path F and the reverse transportation path FR along which a sheet S is transported correspond to the "transportation paths" of the invention.

Further, in this embodiment, the distance Dex, which is calculated by multiplying the time Tex needed for switching of the developers by the travel speed V of the intermediate transfer belt 71, corresponds to the "switching distance" of the invention. The region on the intermediate transfer belt 71 (See FIG. 8B.) where toner images are formed in the single monochrome mode corresponds to the "image forming region" of the invention. The regions between toner images on the intermediate transfer belt 71 correspond to the "inter-image regions" of the invention, and the region between the toner images I34 and I35 in FIG. 8C in particular corresponds to the "first inter-image region" of the invention. The quartet monochrome mode according to this embodiment corresponds to the "switching-involving image forming operation" of the invention.

The invention is not limited to the embodiment above, but may be modified in various manners in addition to the preferred embodiments above, to the extent not deviating from the object of the invention. For instance, the toner image arrangement in the quartet monochrome mode may be as described below.

Figure 9A:
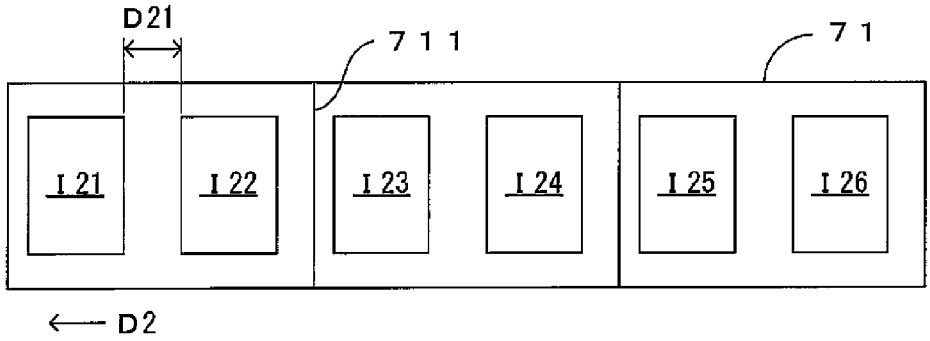
FIGS. 9A, 9B, 9C and 9D are drawings of examples that the toner image arrangement in the quartet monochrome mode is modified.

FIGS. 9A, 9B, 9C and 9D are drawings of examples that the toner image arrangement in the quartet monochrome mode is modified. It is to be noted however that FIG. 9A is the same as FIG. 8B and provides for comparison to highlight the features of the modified toner image arrangements.

Figure 9B:
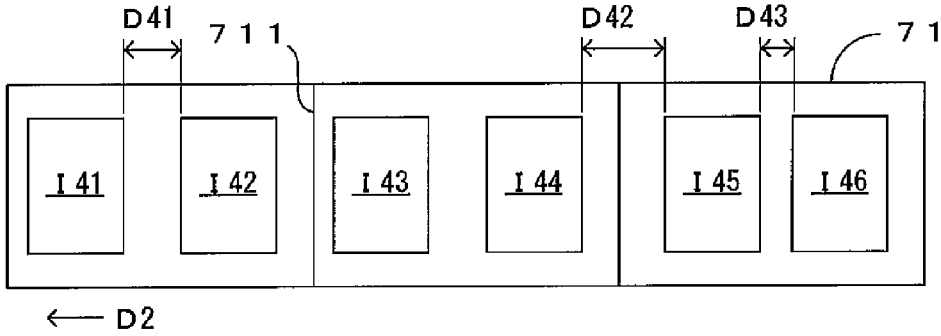

In the modification shown in FIG. 9B, with a toner image immediately following switching of the developers shifted backward (to the right-hand side in FIG. 9B), the interval between the toner image to be formed before the switching and the toner image to be formed after the switching is widened. In short, the first four toner images (I41, I42, I43 and I44) are formed at the same positions as those (FIG. 9A) in the single monochrome mode (D41=D21). The fifth toner image I45 is moved backward and the gap D43 from the sixth toner image I46 is reduced, thereby widening the gap D42 from the fourth toner image I44 (D42≧Dex). This also attain a similar effect to that according to the embodiment described above. Further, since the position of the toner image right after switching is changed in this example, the positions of the toner images do not change immediately before the switching of the developers. This is advantageous in that it is possible to switch the developers promptly upon toner shortage in the currently used developer.

Figure 9C:
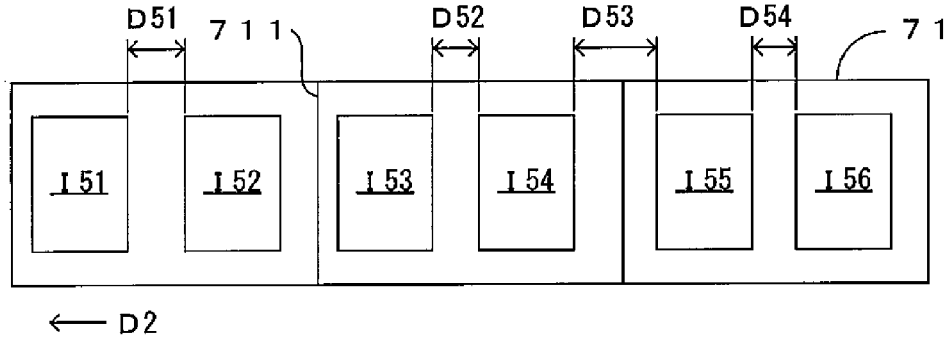

In the example in FIG. 9C, toner images, one right before switching of the developers and the other right after the switching, are shifted. That is, when switching of the developers needs be performed between the fourth toner image I54 and the fifth toner image I55, the first three toner images I51, I52 and I53 are positioned the same as their counterparts in the single monochrome mode. The gaps D51 between these therefore are the same as the gaps D21 created in the single monochrome mode. The fourth toner image I54 is then moved forward (to the left-hand side in FIG. 9C) while the fifth toner image is moved backward (to the right-hand side in FIG. 9C). As a result, the gap D52 between the toner images I53 and I54 and the gap D54 between the toner images I55 and I56 become somewhat smaller, and the gap D53 between the toner images I54 and I55 becomes wider (D53>Dex). In this example, since the gap between the toner images I53 and I54 may be halved, it is possible to further enhance the effect of suppressing a jam.

Figure 9D:
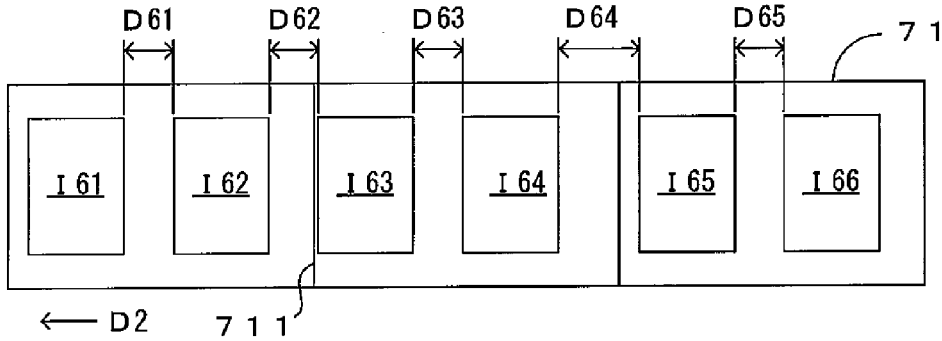

Meanwhile, in the example in FIG. 9D, all toner images except for toner images I61 and I65 which are formed right after switching are shifted each slightly, ensuring a gap which is needed for switching of the developers. In other words, the toner images I62, I63, I64 and I66 are moved a little forward. More preferably, the gaps D61, D62, D63 and D65 between these toner images are equal to each other. This ensures the gap D64 (≧Dex) which is required for switching of the developers. In this example, since the gaps between the respective toner images are reduced each only a little, the effect of suppressing a jam is eminent, and further, it is possible to form the toner images equidistant from each other except for during switching of the developers. This is particularly effective for a situation that a constant number of toner images need be formed using one developer.

In addition, the embodiment above requires that the sheet detection sensor 88, which is disposed in the vicinity of the gate roller 81 located before the secondary transfer region TR2 on the transportation path F, detects whether there is a sheet at this location or whether a jam has occurred. This is not limiting, however. Whether there is a sheet or whether a jam has occurred may be detected based on an output from one sensor disposed at other position on the transportation path which may be for instance immediately after the cassette 8, between the gate roller 81 and the secondary transfer region TR2, after the secondary transfer region TR2, etc., or a combination of outputs of multiple sensors disposed at such positions. The effect of suppressing a jam according to the invention works also on a jam which occurs at any position on the transportation path.

Although the embodiment above is directed to an apparatus comprising the single cassette 8, apparatuses of this type include those which can mount plural cassettes or are structured so as to feed a sheet S from a manual paper feed tray as well. The invention is applicable also to such apparatuses. In such an apparatus however, due to different lengths of transportation paths, the likeliness of a jam is different depending upon where a sheet comes from. In accordance with the differences between the transportation paths therefore, how the developers are switched may be changed. Since it is generally considered that the longer a transportation path is, more easily a transportation delay causes a jam, it is preferable that the longer a transportation path is, less frequently switching is performed.

Further, while the embodiment above is the application of the invention to an image forming apparatus which comprises the intermediate transfer belt 71 which serves as an image carrier, the invention is applicable also to an apparatus which omits such an intermediate transfer member but is structured so as to transfer a toner image from a photosensitive member directly to a recording member, in which case the photosensitive member functions as the "image carrier" of the invention. The invention is further applicable to an apparatus which comprises other intermediate transfer member than an intermediate transfer belt, e.g., an intermediate transfer drum and an intermediate transfer sheet.

Although the image forming apparatus according to the embodiment above is structured so as to execute the color printing mode and the single monochrome mode in addition to the quartet monochrome mode, the color printing mode and the single monochrome mode are not indispensable for the purpose of the invention. The invention is therefore generally applicable to any apparatus which, even if not equipped with these printing modes, comprises multiple developers for the same color and form monochrome images amounting to plural pages while switching these developers. Further, the toner color for monochrome images is not limited to black, and the number of the developers is not limited to 4.

In addition, the invention is applicable not only to image forming apparatuses of the electrophotographic type as that described above but also to an apparatus which operates under other method, e.g., a method which requires splashing toner over a transfer medium to thereby form an image for instance.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a positioning unit which is structured so as to mount plural developers holding toner of the same color and which selectively moves and positions one of the mounted developers to a predetermined development position;

an image carrier which carries toner images on its surface and which rotates in a predetermined direction; and a controller which executes an image forming operation of forming a toner image using the developer positioned at the development position and making the image carrier carry the toner image, wherein when a switching distance is defined as a distance that the surface of the image carrier moves during a switching time which is necessary to switch from the developer positioned to the development position to other developer by the positioning unit, the controller executes, as the image forming operation of forming three or more pages of toner images on the image carrier one after another while securing predetermined inter-image regions between the toner images, a switching-involving image forming operation of forming a predetermined number of pages of toner images using one developer, making the positioning unit switch the developer at the development position to the next developer, and thereafter forming toner images of subsequent pages using the next developer, and gaps between the toner images formed on the image carrier during the switching-involving image forming operation taken along the direction in which the image carrier moves are equal to or longer than the switching distance in a first inter-image region which is between the toner images which are formed immediately before and immediately after the switching of the developers but shorter than the switching distance in other inter-image regions.

2. The image forming apparatus of claim 1, wherein the image carrier is a latent image carrier which carries an electrostatic latent image, and the toner images are formed as toner held in the developer positioned at the development position is provided to a surface of the latent image carrier and electrostatic latent images are accordingly visualized.

3. The image forming apparatus of claim 1, further comprising a latent image carrier which carries an electrostatic latent image, wherein the toner images are formed as toner held in the developer positioned at the development position is provided to a surface of the latent image carrier and electrostatic latent images are accordingly visualized, and the image carrier is an intermediate transfer member onto which the toner images thus visualized on the latent image carrier are transferred.

4. The image forming apparatus of claim 1, wherein on a peripheral surface of the image carrier, plural image forming regions are set in advance such that the image forming regions are spaced apart by shorter gaps than the switching distance along the direction in which the image carrier moves, and during the switching-involving image forming operation, of the plural toner images, those other than the two on the both sides the first inter-image region are formed within the image forming regions and at least one of the two toner images on the both sides of the first inter-image region is formed at a position which is shifted toward a direction which widens the first inter-image region relative to the image forming region which corresponds to the at least one of the two toner images, thereby ensuring that the gap between the two toner images on the both sides of the first inter-image region is equal to or longer than the switching distance.

5. The image forming apparatus of claim 1, wherein the gaps between the toner images in the respective inter-image regions but for those in the first inter-image region are equal to each other.

6. The image forming apparatus of claim 1, wherein the image carrier is an endless structure which is obtained by joining the both ends of a sheet member whose surface is capable of carrying toner images and which therefore has a seam, and the toner images are formed so that the seam will be located within the first inter-image region.

7. The image forming apparatus of claim 1, further comprising:

a transportater which transports plural sheet-like recording members one after another to a transfer position at which a toner image is transferred from the image carrier along a predetermined transportation path; and a jam detector which detects a jam occurring on the transportation path, wherein the controller changes the timing of switching the developers during the switching-involving image forming operation, based on the detection result obtained by the jam detector.

8. The image forming apparatus of claim 1, further comprising:

a transporter which transports plural sheet-like recording members one after another to a transfer position at which a toner image is transferred from the image carrier along a predetermined transportation path; and a recording member detector which detects whether there is the recording member at a predetermined detection position which is provided on the transportation path, wherein the controller changes the timing of switching the developers during the switching-involving image forming operation, based on the detection result obtained by the recording member detector.

9. The image forming apparatus of claim 8, wherein the transporter selects one transportation path from among plural transportation paths, and transports the sheet-like recording members one after another along thus selected transportation path to the transfer position, and the controller changes the timing of switching the developers during the switching-involving image forming operation, in accordance with the length of the transportation path.

10. The image forming apparatus of claim 9, comprising plural repositories which store the recording members and from which the recording members are fed onto the transportation paths, wherein the transportation paths are set each for each one of the repositories.

11. An image forming method of forming, on an endless image carrier which rotates in a predetermined direction, three or more pages of toner images one after another while securing predetermined inter-image regions between the toner images, comprising:

selectively positioning plural developers holding toner of the same color to a predetermined development position;

forming primarily a predetermined number of pages of toner images using the developer positioned at the development position and making the endless image carrier, which rotates in the predetermined direction, carry the toner images;

switching from the developer which is at the development position to other developer after the image forming; and forming secondarily remaining pages of toner image using the developer newly positioned at the development position and making the image carrier carry the toner images, wherein when a switching distance is defined as a distance that the surface of the image carrier moves during a switching time which is necessary to switch from the developer which is positioned at the development position to other developer, and a gap between the respective toner images which are formed at the primary image and at the secondary image forming is shorter than the switching distance, while a gap between a toner image which is formed at the end of the primary image forming and a toner image which is formed at the beginning of the secondary image forming is equal to or longer than the switching distance.

* * * * *